US006007019A

United States Patent [19]

Lynch

[11] Patent Number: 6,007,019

[45] Date of Patent: Dec. 28, 1999

[54] TOILET TISSUE AND PAPER TOWEL HOLDER

[76] Inventor: John B. Lynch, 1127 Miami Blvd., Delray Beach, Fla. 33483

[21] Appl. No.: 09/094,878

[22] Filed: Jun. 15, 1998

[51] Int. Cl.[6] ..... B65H 16/06; B65H 18/04

[52] U.S. Cl. ..... 242/598.2; 242/598.5; 242/599.3

[58] Field of Search ..... 242/598.1, 598.2, 242/598.5, 599.3, 597, 597.8, 596.3

[56] References Cited

U.S. PATENT DOCUMENTS

| | | | |
|---|---|---|---|
| 2,517,809 | 8/1950 | Tarzian | 242/598.2 |
| 4,416,425 | 11/1983 | Kish | 242/598.1 |
| 4,432,504 | 2/1984 | Pace | 242/598.1 |
| 5,718,396 | 2/1998 | Maresca | 242/598.2 |
| 5,765,775 | 6/1998 | Keserica | 242/597.5 |
| 5,868,744 | 2/1999 | Melnick | 242/598.2 X |

*Primary Examiner*—John Q. Nguyen
*Attorney, Agent, or Firm*—Oltman, Flynn & Kubler

[57] ABSTRACT

An apparatus used to hold rolls of disposable paper such as toilet paper or paper towels is disclosed. The device includes a magnetic device of securing a cylindrical spindle between two lateral supports such that the paper roll may rotate freely around the spindle without falling off. One lateral support is adapted for limited rotation on a swivel mechanism and has attached to it the cylindrical spindle. This design facilitates easy loading of new paper rolls and unloading of used rolls. The device also includes a mounting plate for positioning on a wall or other structure. Finally, it may take on a variety of aesthetically pleasing forms while still retaining its useful features.

4 Claims, 4 Drawing Sheets

TOILET TISSUE AND PAPER TOWEL HOLDER

This invention relates generally to dispensers and in particular to a device adapted to hold rolled paper products such as toilet tissue or paper towels.

BACKGROUND OF THE INVENTION

Devices are known in the art which hold rolled paper towels or toilet tissue on a cylindrical tube. The paper is typically rolled around a cardboard tube and the cylindrical tube provided by the device passes through this cardboard tube. These devices allow the rolled paper to rotate freely about the cylindrical tube without falling off. A well known method of achieving this result is to use a cylindrical tube which is telescopic and spring-loaded. This tube is then compressed to fit inside the cardboard tube of the rolled paper. The rolled paper is then fitted between two lateral supports and the spring-loaded cylindrical tube expands to fit against each of the supports, thereby holding the assembly in place while allowing the rolled paper to turn freely.

This method of attachment is awkward and often difficult to use. Installation of the rolled paper and removal of the empty cardboard tubes requires coordination and dexterity which may make these devices unusable for some. While this method of holding rolled paper is not without merit, it does not provide the ease and convenience of use of the present invention. The present invention relates to a holder for these rolled papers which includes a novel and convenient method of attachment. This new method of attachment causes the present invention to substantially depart from the prior art.

SUMMARY OF THE PRESENT INVENTION

The device disclosed herein may have several embodiments. Generally the invention consists of a spindle held between two lateral supports. The spindle is used to hold a roll of disposable paper, such as toilet paper or paper towels.

A primary object of this invention is to provide a device for securely holding rolls of disposable paper while allowing the paper roll to rotate freely for easy dispensing of the paper product and to permit convenient and easy loading and unloading of the paper rolls.

A further object of this invention is to provide an aesthetically pleasing device with which to hold and dispense paper rolls.

DESCRIPTION OF THE PREFERRED EMBODIMENTS

Before explaining the disclosed embodiments of the present invention in detail it is to be understood that the invention is not limited in its application to the details of any particular arrangement shown since the invention is capable of other embodiments. Also, the terminology used herein is for the purpose of description and not of limitation.

Figure 1:
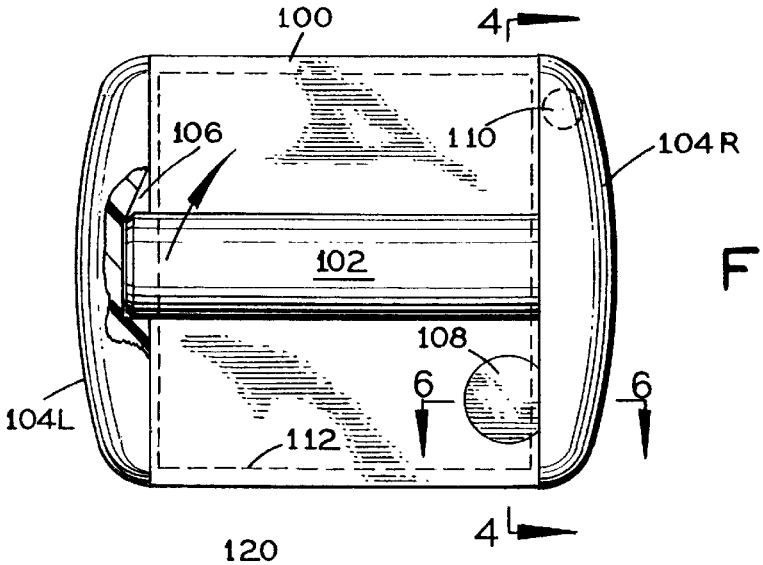
FIG. 1 shows a fragmentary sectional front elevational view of the invention.

FIG. 1 shows a fragmentary sectional front elevational view of the rolled paper holder 100. The invention consists of a cylindrical spindle 102 which is adapted to pass through the center of a cardboard tube holding a rolled paper product 112. The spindle is held in place by two lateral supports 104R and 104L. The spindle is fixed to one lateral support 104R, while the opposite lateral support 104L includes a spindle recess cavity 106 which engages the end of the spindle. A swivel mechanism 108 is included and allows for clockwise rotation of the lateral support 104R to which it is attached. The spindle 102 rotates with this lateral support 104R and may assume a vertical orientation.

During normal operation the spindle 102 is in its horizontal position as shown with a roll of disposable paper 112 fitted over the spindle 102. This allows the roll of paper 112 to spin freely for convenient dispersal. Alternatively the lateral supports 104L and 104R may be aligned to impose a slight friction on the roll of paper 112. This would permit dispersal of only a limited amount of paper at a time. A recessed magnet 110 is shown through cut away and is used to hold the rotatable lateral support 104R in a horizontal position. By design gravity assists in this endeavor, helping to keep the rotatable lateral support 104R in its horizontal position by pulling down on the spindle 102.

Figure 2:
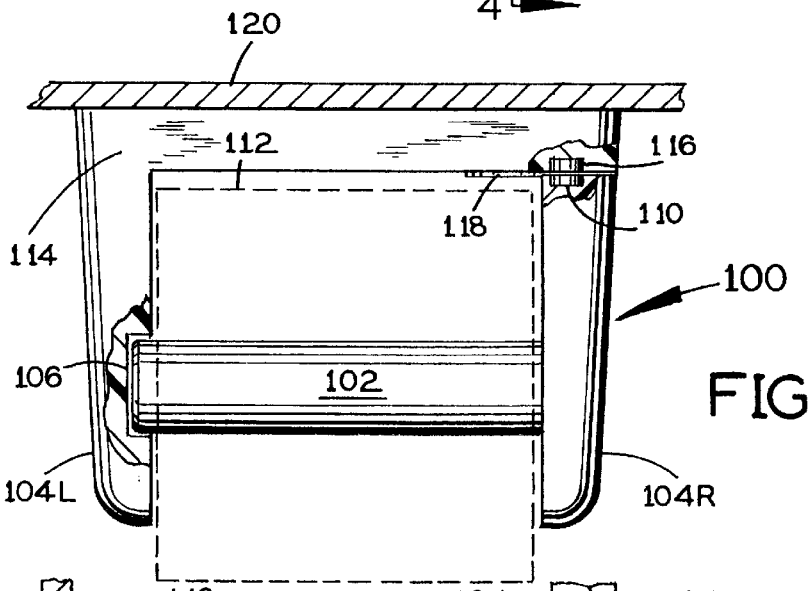
FIG. 2 shows a fragmentary sectional top plan of an embodiment similar to FIG. 1.

FIG. 2 shows a fragmentary sectional top plan of an embodiment of the invention similar to FIG. 1. This drawing depicts the base plate 114 to which one lateral support 104L is fixedly attached and another lateral support 104R is rotatably attached. The base plate 114 is affixed to a wall or other support structure 120 to allow a user access to the roll of paper 112. This drawing also shows the spindle 102, which is engaged with the spindle recess cavity 106 in this position. Two recessed magnets 116 and 110 are installed so that their opposite polarities align. One magnet 116 is installed in the base plate 114 and another magnet is installed in the side of the rotatable lateral support 104R. The attraction between these two magnets holds the rotatable lateral support 104 such that the spindle 102 is in a horizontal position when in use. Part of the swivel mechanism, a disk shaped flange 118, is attached to one side of the rotatable lateral support 104R.

Figure 3:
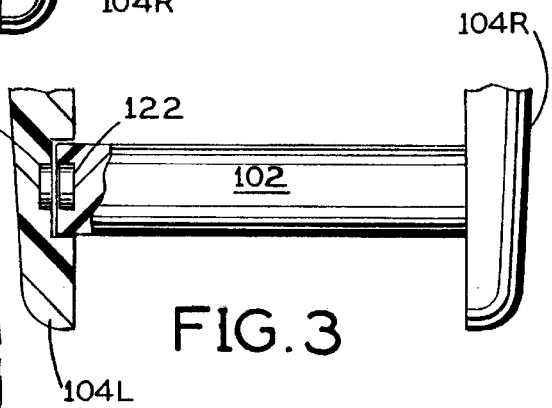
FIG. 3 shows a fragmentary sectional top plan of another embodiment of the invention.

FIG. 3 shows a fragmentary sectional top plan of another embodiment of the invention. In this particular embodiment one recessed magnet 124 is installed in the recess cavity 106 on the lateral support 104L. Another recessed magnet 122 is installed in the end of the spindle 102 which is attached to the rotatable lateral support 104R. These magnets serve a function similar to those depicted in FIG. 2, which is to hold the spindle 102 in a horizontal position. Again they are aligned so that their opposite polarities face one another and they impose an attractive force upon each other.

Figure 4:
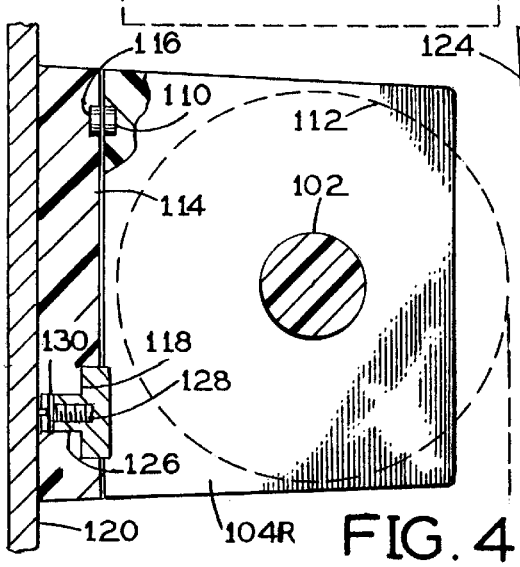
FIG. 4 shows a fragmentary sectional lateral perspective of an embodiment similar to FIG. 1.

FIG. 4 shows a fragmentary sectional lateral perspective of an embodiment similar to FIG. 1. The two recessed magnets 110 and 116 are aligned so that they impose an attractive force on one another. The roll of paper 112 is shown partially unrolled. The base plate 114 is affixed to a wall or other structure 120. The swivel mechanism is shown here in greater detail and shows how the lateral support 104R is rotatably attached to the base plate 114. This lateral support 104R is also attached to the spindle 102. The disc-shaped flange 118 is affixed to the rotatable lateral support 104R and also to a circular hub 126. This hub 126 is cylindrical and has an inner thread which is adapted to engage a screw 128. Alternatively the cylindrical hub 126 and the disc-shaped flange 118 may be constructed such that they are one piece, instead of two pieces fixed to one another. A washer 130 fits between the screw and the recess of the base plate 114. The recess in the base plate is provided so that the screw 128 will mount flush with the back of the base plate 114. This assembly allows the lateral support 104R to rotate on an imaginary axis through the center of the screw 128.

Figure 5:
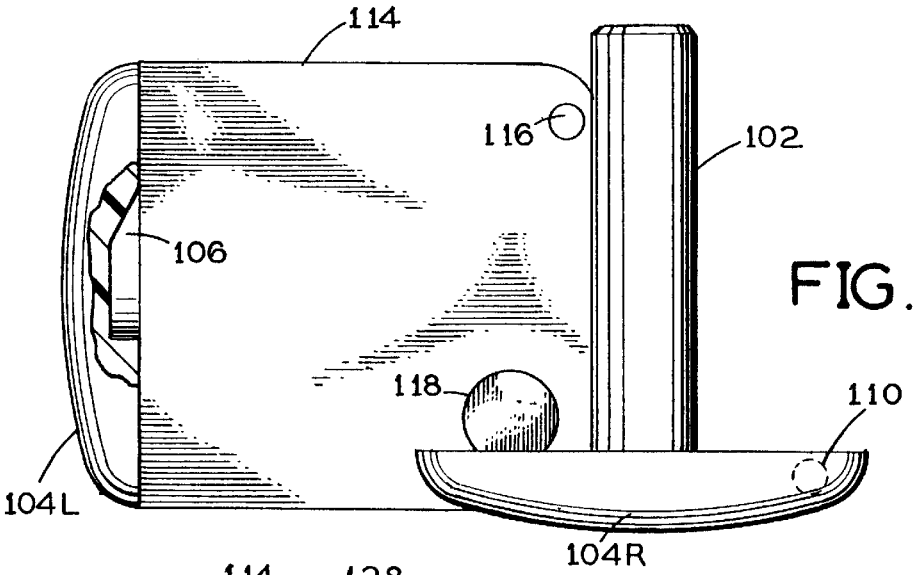
FIG. 5 shows a fragmentary sectional front elevational view of an embodiment similar to FIG. 1.

FIG. 5 shows a fragmentary sectional front elevational view of an embodiment similar to FIG. 1. In this drawing, the rotatable lateral support 104R has been turned to hold the spindle 102 in its upright position. Again the disc-shaped flange 118 is affixed to the rotatable lateral support 102. In this position however, the two magnets 110 and 116 are separated. They are only intended to function when the spindle 102 is placed in a horizontal attitude. The particular shape of the recess cavity 106 in the lateral support 104L is shown here, with a cutout at the top of the cavity to allow the spindle 106 to enter and exit the cavity. In this position a roll of paper may be placed on the spindle or removed therefrom. The vertical attitude of the spindle makes such installation and removal quick and easy for the user.

Figure 6:
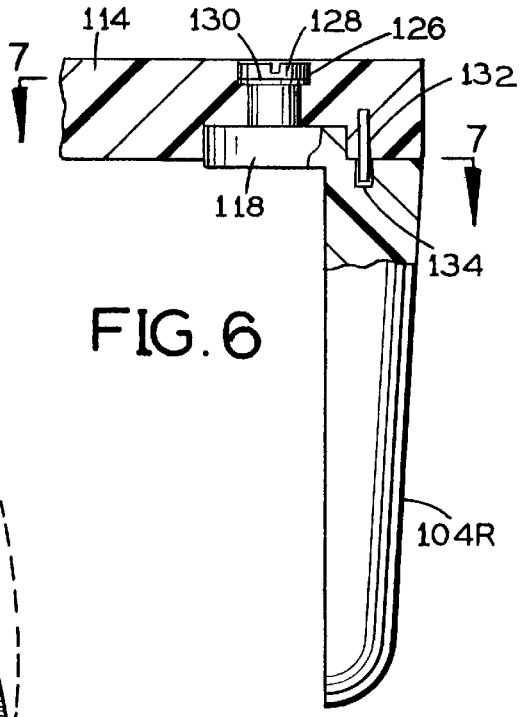
FIG. 6 shows a fragmentary sectional top plan of part of the invention embodied in FIG. 1.

FIG. 6 shows a fragmentary sectional top plan of part of the invention embodied in FIG. 1. In particular this drawing shows the swivel mechanism. The screw 128 passes through the washer 130 and engages the hub 126 and disc-shaped flange 118 thereby rotatably affixing the lateral support 104R to the base plate 114. A stop limit pin 132 is fixed to the front of the base plate 114 so that it engages a stop limit slot 134 on the lateral support 104R. This slot 134 is arc-shaped and follows the outer edge of the disc-shaped flange 118. The ends of the arc define the limits of rotation for the lateral support 104R. Preferably the slot 134 is of a length such that the spindle may rotate ninety degrees between a horizontal and a vertical position. Alternatively various hinged equivalents may be used in lieu of the depicted swivel mechanism.

Figure 7:
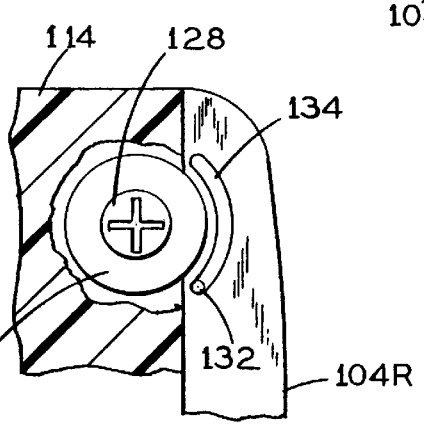
FIG. 7 shows a fragmentary sectional rear view of part of the invention embodied in FIG. 1.

FIG. 7 shows a fragmentary sectional rear view of part of the invention embodied in FIGS. 1 and 6. This drawing shows another perspective of the swivel mechanism. A portion of the base plate 114 is shown cut away so that the disc-shaped flange 118 may be seen below the screw 128. The arc-shaped stop limit slot 134 of the lateral support 104R partially follows the outer edge of the disc-shaped flange 118. The stop limit pin 132 rests within the stop limit slot 134 and is affixed to the base plate 114, thereby limiting the rotation of the lateral support 104R to the ends of the stop limit slot 134.

Figure 8:
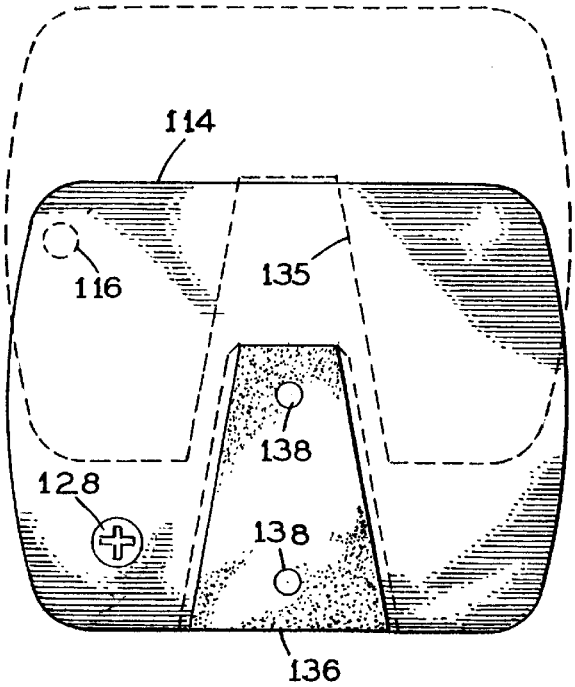
FIG. 8 shows a rear elevational view of an embodiment of the invention similar to FIG. 1.

FIG. 8 shows a rear elevational view of an embodiment of the invention similar to FIG. 1. The base plate 114 is shown with a wedge-shaped recess 135 cut out which accommodates a mounting plate 136. The mounting plate 136 is similarly wedge-shaped and has two holes 138 which enable one to affix the mounting plate 136 to a wall or other structure by means of screws. The mounting plate 136 may alternatively have an adhesive applied such that it may be adhesively attached to a wall or other structure. This alternative embodiment may or may not include the use of the aforementioned screws. Any suitable mounting may be used.

Figure 9:
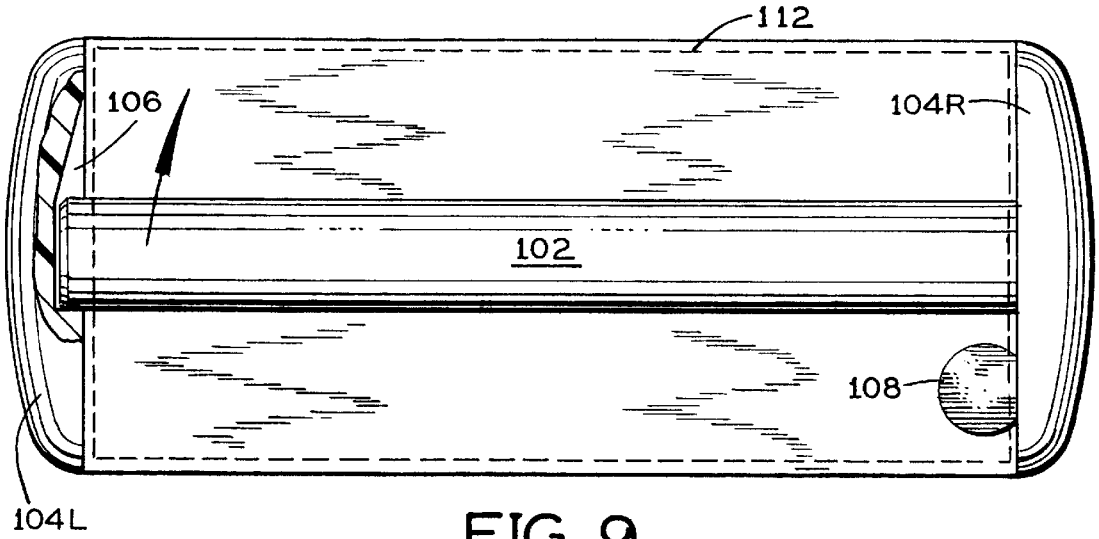
FIG. 9 shows a fragmentary sectional front elevational view of another embodiment of the invention.

FIG. 9 shows a fragmentary sectional front elevational view of another embodiment of the invention. In this embodiment the lateral supports 104L and 104R are separated by a greater distance than seen in previous embodiments. This allows the device to hold a paper roll 112 of greater width. This embodiment is particularly useful in the case of paper towels which are typically of a greater width than toilet paper. A swivel mechanism 108 similar to those depicted in other figures is used here. Alternatively various hinged equivalents may be used in lieu of the depicted swivel mechanism.

Figure 10:
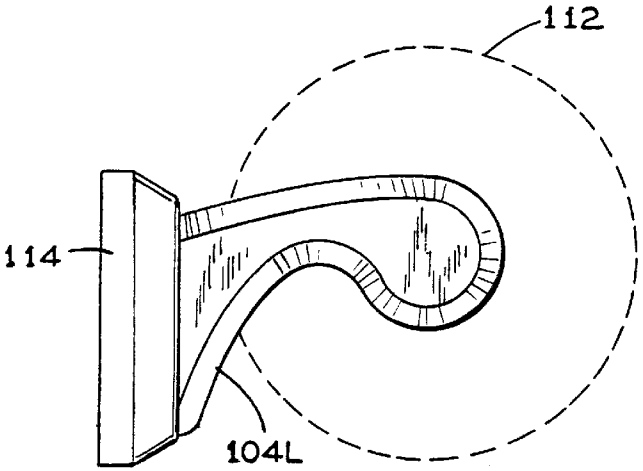
FIG. 10 shows a side view of an embodiment of the invention in position when used.

FIG. 10 shows a side view of an embodiment of the invention in position when used. The lateral support 104L is attached to the base plate 114 and is shown with the paper roll 112 installed. This drawing depicts the variety of shapes these parts may assume to enhance the overall aesthetic and functional qualities of the device. In this drawing the base plate 114 and lateral support 104L is vertically shortened. This smaller size device may be useful for installation in areas where space is a premium.

Figure 11:
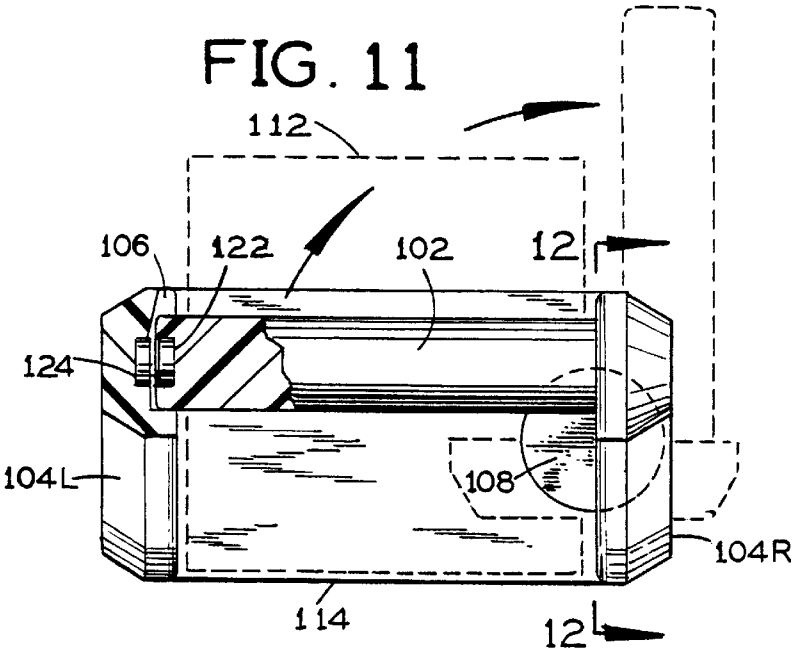
FIG. 11 shows a fragmentary sectional front elevational view of another embodiment of the invention.

FIG. 11 shows a fragmentary sectional front elevational view of an embodiment of the invention similar to that shown in FIG. 10. This drawing depicts a device with a shortened base 114 and shortened lateral supports 104L and 104R. The functionality of the device is not substantially different from other embodiments. This embodiment does require that the recessed magnets 124 and 122 be placed at the end of the spindle 102 and inside the spindle recess cavity 124 as shown in FIG. 3.

Figure 12:
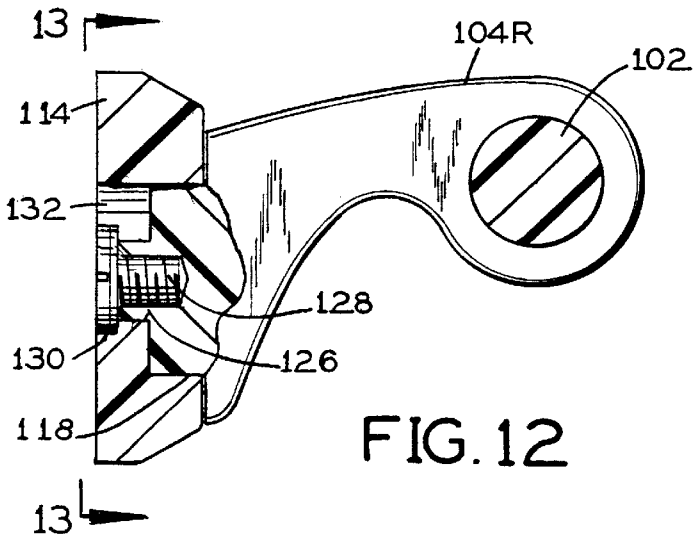
FIG. 12 shows a fragmentary sectional side view of one embodiment of the invention.

FIG. 12 shows a fragmentary sectional side view of an embodiment of the invention similar to FIG. 10. A portion of the base plate 114 is cut away to show the swivel mechanism. The screw 128 passes through the washer 130 and engages the hub 126 and disc-shaped flange 118 thereby rotatably affixing the lateral support 104R to the base plate 114. The drawing also shows the stop limit pin 132.

Figure 13:
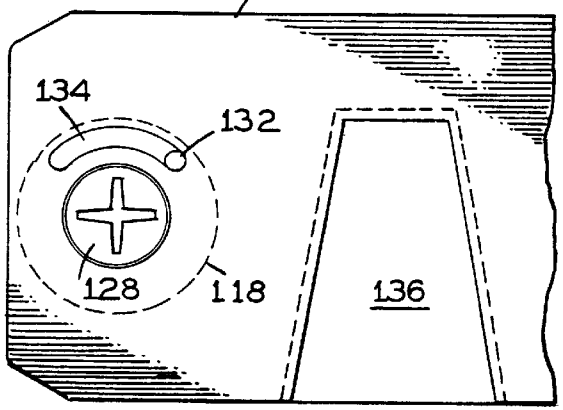
FIG. 13 shows a rear view of an embodiment of the invention similar to FIG. 11.

FIG. 13 shows a rear view of an embodiment of the invention similar to FIGS. 7 and 10. The base plate 114 shown is both shorter and of lesser thickness than in previous embodiments. The base plate 114 is depicted in useful position with the mounting plate 136. Also depicted is the screw 128, the stop limit pin 132, and the stop limit slot 134.

Figure 14:
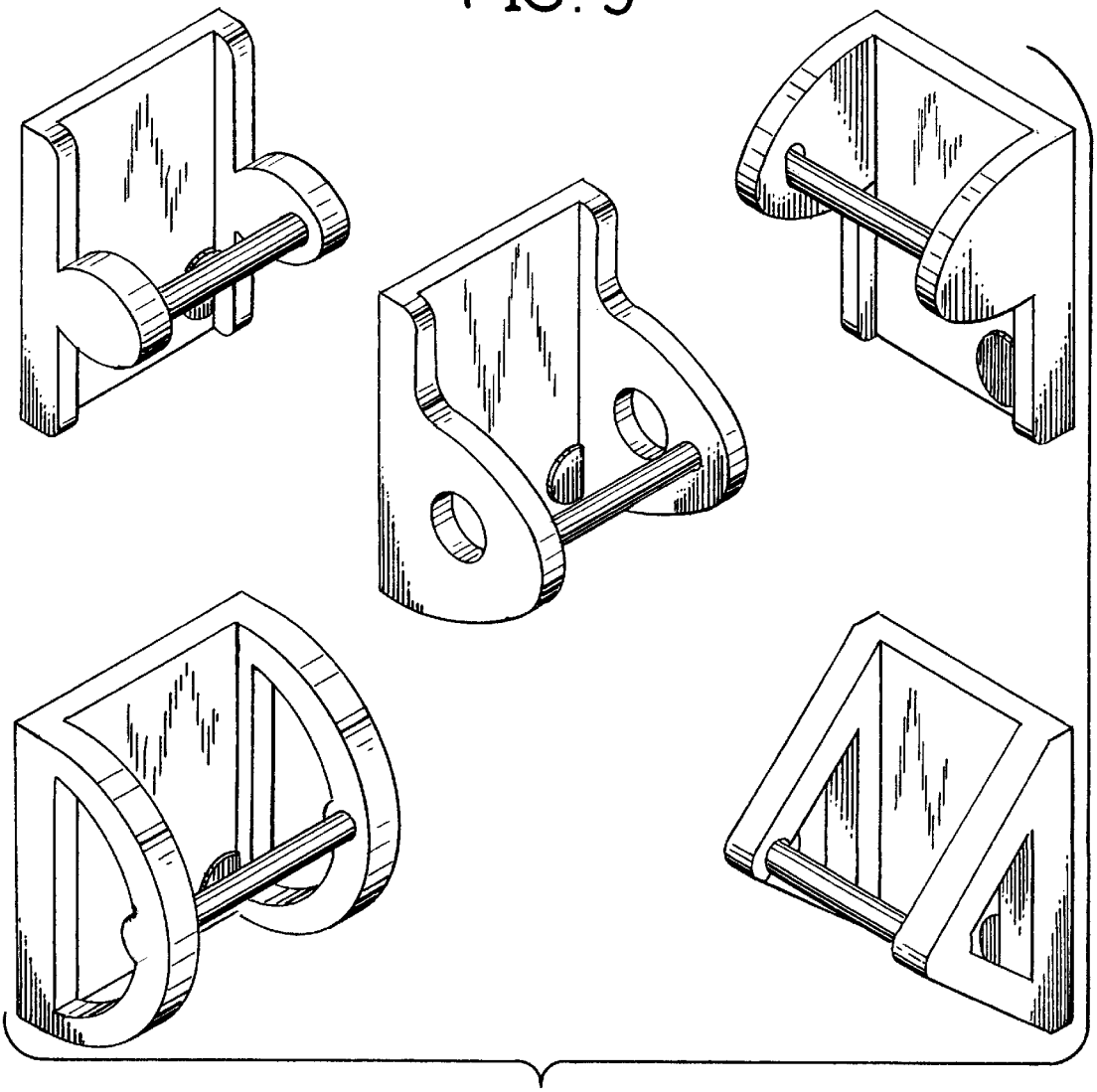
FIG. 14 shows various views of several embodiments of the invention.

FIG. 14 shows various views of several embodiments of the invention. In particular the lateral supports may take on a variety of shapes and sizes. It is also noteworthy that the device may be constructed from a variety of materials and in a variety of colors without significantly changing the inventive characteristics presented herein.

While the invention has been described, disclosed, illustrated, and shown in various terms and certain embodiments, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A rolled paper holder comprising:

a base plate having a bottom, a front and a back side;

a cylinder spindle with two opposite ends adapted to pass through a cardboard tube holding rolled paper;

first and second lateral supports each having a flat planar surface and at least two sides, said supports being attached to and outwardly extending from the front of the base plate and aligned parallel to each other at a distance such that the cylinder spindle fits horizontally between the supports;

means for removably securing the spindle between the lateral supports;

a swivel mechanism is attached between said first lateral support and said base plate, thereby allowing said first lateral support to rotate away from said second parallel lateral support, wherein one end of said spindle is attached to the rotatable first lateral support;

wherein said swivel mechanism comprises a disk-shaped flange having two flange sides, one said flange side being fixedly attached to one side of the rotatable first lateral support; a hub fixedly attached to the center of said flange on the flange side opposite the rotatable first lateral support, said hub having a circular outer surface and a threaded inner surface adapted to accommodate the threaded portion of a screw; a curved edge on the side of the rotatable first lateral support attached to said one flange side, said edge defining an arched stop limit slot and being positioned outside the disk-shaped flange; a stop limit pin fixedly attached to the front of the base plate and positioned so as to engage the curved edge defining the stop limit slot on the rotatable first lateral support, such that the pin will limit the rotation of said first lateral support; a circular edge defining a recess cavity on the base plate, adapted to accommodate the disk-shaped flange; a screw with an enlarged head; a circular washer; a circular edge defining a hole in the center of said cavity, adapted to accommodate the hub; and another circular edge defining a cavity on the back side of said base plate adapted to accommodate the head of said screw, whereby said screw will install flush with the back side of the base plate, extend through said washer and through the base plate to engage the threaded inner surface of the hub; and a spindle receptor consisting of a circular edge which defines a recess cavity in said second lateral support whereby the spindle fits into the spindle receptor when the spindle is rotated into a horizontal position.

2. The device of claim 1, additionally comprising:

three edges which define a wedge-shaped recess on the back of the base plate intended to accommodate a mounting plate, said three edges comprising a horizontal top edge connected to the two side edges which continue downwardly therefrom and away from each other to the bottom of the base plate; and a mounting plate having a wedge shape adapted to complement the recess on the back of the base plate and having an adhesive backing to affix the mounting plate to a wall or other structure as well as two circular edges which define mounting holes for screws.

3. A rolled paper holder comprising:

a base plate having a bottom, a front and a back side;

a cylinder spindle with two opposite ends adapted to pass through a cardboard tube holding rolled paper;

first and second lateral supports each having a flat planar surface and at least two sides, said supports being attached to and outwardly extending from the front of the base plate and aligned parallel to each other at a distance such that the cylinder spindle fits horizontally between the supports;

means for removably securing the spindle between the lateral supports;

a swivel mechanism is attached between said first lateral support and said base plate, thereby allowing said first lateral support to rotate away from said second parallel lateral support, wherein one end of said spindle is attached to the rotatable first lateral support;

wherein said swivel mechanism comprises a disk-shaped flange having two flange sides, one said flange side being fixedly attached to one side of the rotatable first lateral support; a hub fixedly attached to the center of said flange on the flange side opposite the rotatable first lateral support, said hub having a circular outer surface and a threaded inner surface adapted to accommodate the threaded portion of a screw; a curved edge on the side of the rotatable first lateral support attached to said one flange side, said edge defining an arched stop limit slot and being positioned outside the disk-shaped flange; a stop limit pin fixedly attached to the front of the base plate and positioned so as to engage the curved edge defining the stop limit slot on the rotatable first lateral support, such that the pin will limit the rotation of said first lateral support; a circular edge defining a recess cavity on the base plate, adapted to accommodate the disk-shaped flange; a screw with an enlarged head; a circular washer; a circular edge defining a hole in the center of said cavity, adapted to accommodate the hub; and another circular edge defining a cavity on the back side of said base plate adapted to accommodate the head of said screw, whereby said screw will install flush with the back side of the base plate, extend through said washer and through the base plate to engage the threaded inner surface of the hub;

a spindle receptor consisting of a circular edge which defines a recess cavity in said second lateral support whereby the spindle fits into the spindle receptor when the spindle is rotated into a horizontal position;

three edges which define a wedge-shaped recess on the back of the base plate intended to accommodate a mounting plate, said three edges comprising a horizontal top edge connected to the two side edges which continue downwardly therefrom and away from each other to the bottom of the base plate; and a mounting plate having a wedge shape adapted to complement the recess on the back of the base plate and having an adhesive backing to affix the mounting plate to a wall or other structure as well as two circular edges which define mounting holes for screws;

wherein said means for securing the spindle comprises an edge defining a first recess cavity for a magnet on the front of the base plate positioned such that the rotatable lateral support covers the cavity when said spindle is oriented horizontally; a similar edge defining a similar second recess cavity on the side of the rotatable lateral support flush with the base plate, said second recess cavity being positioned such that said second recess cavity is adjacent to the first recess cavity on the base plate when said spindle is oriented horizontally; and two magnets, one being fixedly attached inside each of said recess cavities in a manner such that, opposite polarities of said two magnets align when the spindle is in said horizontal position, thereby holding the spindle in a horizontal position with the spindle extending horizontally between the two lateral supports and into the spindle receptor.

4. A rolled paper holder comprising:

a base plate having a bottom, a front and a back side;

a cylinder spindle with two opposite ends adapted to pass through a cardboard tube holding rolled paper;

first and second lateral supports each having a flat planar surface and at least two sides, said supports being attached to and outwardly extending from the front of the base plate and aligned parallel to each other at a distance such that the cylinder spindle fits horizontally between the supports;

means for removably securing the spindle between the lateral supports;

a swivel mechanism is attached between said first lateral support and said base plate, thereby allowing said first lateral support to rotate away from said second parallel lateral support, wherein one end of said spindle is attached to the rotatable first lateral support;

wherein said swivel mechanism comprises a disk-shaped flange having two flange sides, one said flange side being fixedly attached to one side of the rotatable first lateral support; a hub fixedly attached to the center of said flange on the flange side opposite the rotatable first lateral support, said hub having a circular outer surface and a threaded inner surface adapted to accommodate the threaded portion of a screw; a curved edge on the side of the rotatable first lateral support attached to said one flange side, said edge defining an arched stop limit slot and being positioned outside the disk-shaped flange; a stop limit pin fixedly attached to the front of the base plate and positioned so as to engage the curved edge defining the stop limit slot on the rotatable first lateral support, such that the pin will limit the rotation of said first lateral support; a circular edge defining a recess cavity on the base plate, adapted to accommodate the disk-shaped flange; a screw with an enlarged head; a circular washer; a circular edge defining a hole in the center of said cavity, adapted to accommodate the hub; and another circular edge defining a cavity on the back side of said base plate adapted to accommodate the head of said screw, whereby said screw will install flush with the back side of the base plate, extend through said washer and through the base plate to engage the threaded inner surface of the hub;

a spindle receptor consisting of a circular edge which defines a recess cavity in said second lateral support whereby the spindle fits into the spindle receptor when the spindle is rotated into a horizontal position;

three edges which define a wedge-shaped recess on the back of the base plate intended to accommodate a mounting plate, said three edges comprising a horizontal top edge connected to the two side edges which continue downwardly therefrom and away from each other to the bottom of the base plate; and a mounting plate having a wedge shape adapted to complement the recess on the back of the base plate and having an adhesive backing to affix the mounting plate to a wall or other structure as well as two circular edges which define mounting holes for screws;

wherein said cylindrical spindle has a free end for abutting said second lateral support, and wherein said means for securing the spindle comprises a circular edge which defines a recess cavity for a magnet centered in the spindle receptor; a second circular edge which defines a recess cavity for a magnet on said free end of the cylindrical spindle, said cavity being positioned such that it is adjacent to the recess cavity inside the spindle receptor when said spindle is in a horizontal position, and two magnets, one being fixedly attached inside each of said recess cavities in a manner such that opposite polarities of said two magnets align when the spindle is in said horizontal position, thereby holding the spindle in a horizontal position with the spindle extending horizontally between the two lateral supports and into the spindle receptor.

* * * * *